United States Patent [19]

Klingesberger

[11] Patent Number: 4,765,171

[45] Date of Patent: Aug. 23, 1988

[54] APPARATUS FOR FLANGING SHEET METAL BLANKS

[75] Inventor: Johann Klingesberger, Lohnsburg, Austria

[73] Assignee: Voest-Alpine Aktiengesellschaft, Linz, Austria

[21] Appl. No.: 72,252

[22] Filed: Jul. 10, 1987

[30] Foreign Application Priority Data

Aug. 14, 1986 [AT] Austria ..... 2191/86

[51] Int. Cl.[4] ..... B21D 5/04

[52] U.S. Cl. ..... 72/316; 72/319; 72/389; 72/481

[58] Field of Search ..... 72/319, 320, 316, 293, 72/322, 389, 481, 482, 413

[56] References Cited

U.S. PATENT DOCUMENTS 4,089,198 5/1978 Amano et al. ..... 72/320
4,112,731 9/1978 Anderson et al. ..... 72/320

FOREIGN PATENT DOCUMENTS 105091 4/1984 European Pat. Off. .
186909 7/1986 European Pat. Off. .
2805654 8/1978 Fed. Rep. of Germany .
148021 9/1983 Japan ..... 72/319
187216 11/1983 Japan ..... 72/319

*Primary Examiner*—Daniel C. Crane
*Attorney, Agent, or Firm*—Collard, Roe & Galgano

[57] ABSTRACT

An apparatus for flanging sheet metal blanks comprises a holding-down ram (4), which is provided with a holding-down shoe (5), that is composed of a plurality of segments, which are arranged in a row and comprise a mid-segment (7) and at each end of the mid-segment a plurality of side segments (6), which are displaceable along said row, which is parallel to a bend line, about which the blank is to be flanged. To facilitate the removal of the mid-segment from the row of segments, the holding-down ram (4) carries a slider, which is displaceable in the direction of movement of the holding-down ram and has a slide track (10), which is open at least at one end and serves to guide the mid-segment (7). The slider (11) is adapted to be raised to a retracted position adjacent to a segment changer (13) for replacing a given mid-segment (7) by another.

17 Claims, 5 Drawing Sheets

FIG. 5
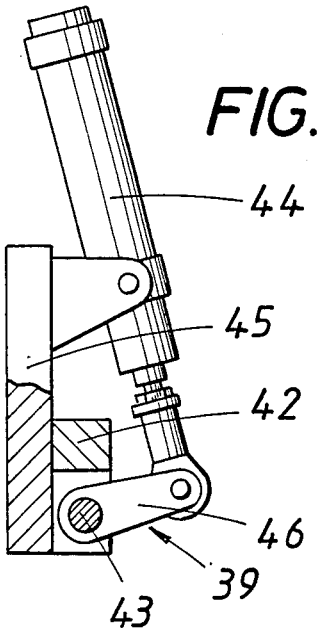
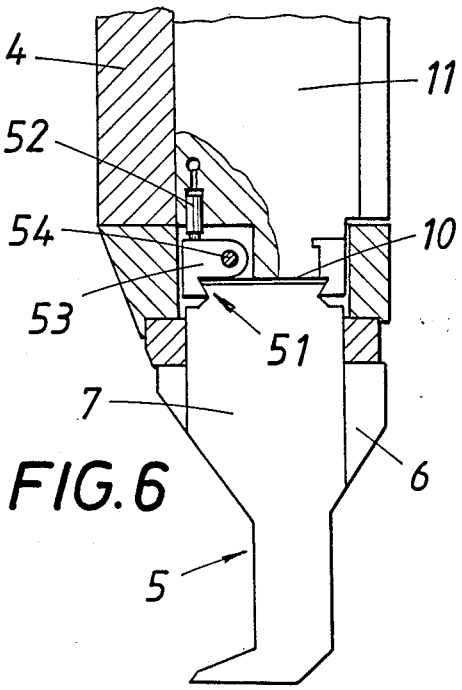
FIG. 6
FIG. 7
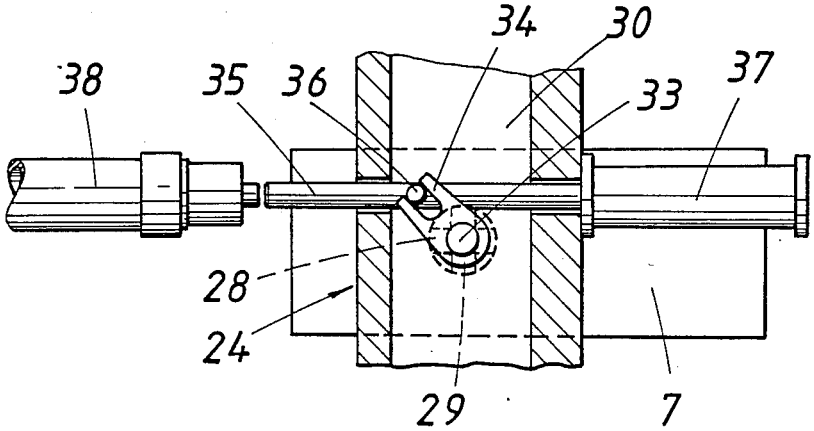

APPARATUS FOR FLANGING SHEET METAL BLANKS

BACKGROUND OF THE INVENTION

1. Field of the Invention

This invention relates to apparatus for flanging sheet metal blanks comprising a machine frame and a holding-down mechanism, which is adapted to hold down a sheet metal blank on a backing structure and comprises a holding-down shoe, which is composed of a plurality of segments arranged in a straight row, and a holding-down ram, which is guided in said frame and operable to force said holding-down shoe onto said blank on said backing structure so that said segments define on said blank a bend line about which said blank is adapted to be flanged, wherein said segments comprise mid-segment means, which are mounted to be displaceable transversely to said row, and side segments, which are disposed on opposite sides of said mid-segment means and are displaceable along said row.

2. Description of the Prior Art

When such apparatus is to be used to form sheet metal blanks with edge flanges, the holding-down shoe must be adjustable in length to the length of the edge flange that is to be formed. From EP A-O 105 091 it is known that this can be accomplished in that the holding-down shoe is composed of a plurality of segments, which are arranged in a row that is parallel to the bend line and can be adjusted along said row. In that case the selection of the number of segments used at a time will permit a coarse adaptation of the length of the holding-down shoe to the length of the edge flange that is to be formed. A fine adjustment is permitted in that a set of narrow segments are provided in the middle portion of the holding-down shoe and each of said narrow segments is pivoted to the holding-down ram on an axis which is parallel to said row so that said narrow segments can selectively be swung in and out for an adjustment of the length of the holding-down shoe in steps which are equal to the length of the narrow segments. But such an arrangement does not permit of a sufficiently fine adjustment because when the blank is to be formed with inturned edge flanges having two or more bends the outermost segments of the holding-down shoe must be displaced inwardly in order to shorten the holding-down shoe so that the latter can be lifted from the workpiece between the inturned edge flanges. Such an inward displacement of the segments of the holding-down shoe is permitted in that a mid-segment is provided at each end of the set of narrow segments and can be pulled out of the row of segments by a movement that is transverse to the row and parallel to the surface of the sheet metal blank and the side segments which are disposed on the outside of said mid-segments can then be displaced inwardly to an extent which is equal to the length of the mid-segment.

That known apparatus involves a relatively high structural expenditure because three kinds of segments are required and the segments of each kind must be separately actuated. Besides, the space required for the transverse displacement of the mid-segments in a direction which is parallel to the surface of the sheet metal blank within the contour of said blank will define a lower limit for the size of the blank. Moreover, the replacement of individual segments is expensive and involves a relatively large downtime of the apparatus.

SUMMARY OF THE INVENTION

It is an object of the invention to avoid said disadvantages and to provide a flanging apparatus which is of the kind described first hereinbefore and is so improved that the length of the holding-down shoe can be changed with relatively simple means and without involving a restriction of the dimensions of the sheet metal blanks which can be flanged.

That object is accomplished in accordance with the invention in that the holding-down ram carries a slider, which in the direction of actuation of the holding-down ram is reciprocable between an extended position and retracted position and carries a slide track, which is parallel to the row of segments and is open at least at one end and is adapted to slidably guide the mid-segment or the mid-segments of the holding-down shoe, and a segment changer is provided, which has a receiving opening that is adapted to receive the mid-segment or mid-segments from the open end of the slide track of the slider when the latter is in its retracted position.

Because the holding-down shoe comprises at least one mid-segment, which is adapted to be removed from the row formed by said segments and which by means of a slider can be lifted from the sheet metal blank in the direction of actuation of the holding-down ram, that arrangement will not impose a restriction on the dimensions of the workpiece. A fine adjustment of the length of the holding-down shoe is permitted by the use of mid-segments which differ in length and which can selectively be inserted between the side segments and can be exchanged in a simple manner by the segment changer. When the slider has been raised to its retracted position, the mid-segments can be exchanged simply in that the mid-segment which is held in the slide track of the slider is pushed beyond the open end of the slide track, into the receiving opening of the segment changer.

The slider is used not only to exchange the mid-segments but can also be used to provide at the center of the row of the segments a space for permitting the side segments of the holding-down shoe to be shifted inwardly as is required when the holding-down shoe is to be raised from the flanged workpiece between inturned edge flanges.

In a preferred embodiment of the invention the mid-segments can be exchanged in a particularly desirable manner if the slide track of the slider is open at both ends and when the slider is in its retracted position that end of the slide track which is opposite to the segment changer adjoins a receptacle which is formed in a stand-by segment holder and adapted to hold at least one mid-segment. In that case the mid-segment which is held by the slider can be pushed into the receiving opening of the segment changer and a mid-segment stored in the stand-by segment holder can be inserted into the slide track of the slider at the same time so that the time required to exchange the mid-segments will be minimized. Similarly, the mid-segment held in the slider can be pushed into the receptacle of the stand-by segment holder and a mid-segment which is held in the receiving opening of the segment changer can be pushed into the slider at the same time. This will permit two mid-segments to be used in alternation, as will be required when rectangular sheet metal blanks are to be flanged at their sides and ends in the usual manner.

The means for displacing the mid-segments between the slider, the stand-by segment holder and the segment changer may desirably comprise a shifting mechanism that is mounted in the holding-down ram and comprises at least two coupling members adapted to be coupled to respective mid-segments. Said two coupling members are adjustable in unison and constitute simple means for a simultaneous shifting of two mid-segments as is required for a quick change. To ensure that the mid-segments need not be shifted in unison and to provide a larger latitude for the shifting of the mid-segments, the means for shifting the coupling members may comprise an axially displaceable shifting rod, the coupling members may be movably mounted on a shaft, which is rotatably mounted on and axially coupled to the shifting rod, and each coupling member may consist of a pivoted lever, which is movable into and out of a coupling pocket of a mid-segment. In dependence on the angular position of the pivoted lever, no mid-segment or at least one mid-segment will be carried along by the shifting rod as it is shifted.

Because the slider is spaced predetermined distances from the stand-by segment holder and the segment changer, the shifting mechanism may be controlled in a simple manner because if said distances are equal it will be sufficient to shift the shifting mechanism between two fixed stops. To ensure that said mechanism for a stop-defined control motion can be moved also to intermediate positions, the shifting mechanism may comprise a shifting cylinder, which is adapted to be displaced by an auxiliary cylinder. That case the stroke of the shifting cylinder will define the two stop-defined end positions of the coupling members and the predetermined path for the shifting of said coupling members can be displaced as desired by means of the auxiliary cylinder. For this reason the shifting cylinder may be pivoted to a lever, which is pivotally movable by the auxiliary cylinder. A pivotal movement imparted to that lever by the auxiliary cylinder will shift the end positions of the coupling members because the points of support of the adjusting cylinder will be shifted accordingly.

The segment changer may have various designs because it is required only to present to the slider a mid-segment which has the length that is required at a time. In a particularly desirable embodiment the segment changer comprises a magazine having a plurality of storage fixtures for holding respective mid-segments and a feeder, which is formed with the receiving opening for one mid-segment and is adapted to transfer a mid-segment received in said opening to any storage fixture of the magazine. When the feeder has received a mid-segment from the slider, the feeder is pivotally moved to deliver said mid-segment to an associated storage fixture of the magazine. In the reverse order, the feeder can be used to take another mid-segment from the magazine and to deliver said mid-segment to the slider. The magazine for storing the various mid-segments must be adjustable relative to the feeder so that the latter can register with each of the storage fixtures. The space existing adjacent to the holding-down ram will be utilized in a particularly effective manner if the storage fixtures of the magazine are arranged in a row that is parallel to the row of segments and the magazine is movable along said row. Because the feeder is pivoted, it will not obstruct the movement of the magazine.

To avoid a loading of the holding-down ram by the magazine, the latter may be displaceably mounted on the frame. In that case the required association of the feeder, which is movably mounted on the holding-down ram, with the magazine is ensured by a movement of the holding-down ram, which must be lifted from the backing structure in any case when the segments of the holding-down shoe are to be exchanged and adjusted.

Each of the storage fixtures for respective mid-segments may comprise a segment holder, which may consist of a rotatably mounted hammer head for entering an undercut socket opening of one of the mid-segments. As the feeder performs an outward pivotal movement, the hammer head enters the socket opening of the mid-segment which is held in the receiving opening of the feeder. The hammer head is subsequently rotated in said socket opening to lock the mid-segment in position in the segment holder. It will be understood that the mid-segment can then be pulled out of the receiving opening of the feeder, e.g., in that the magazine is shifted, as the receiving opening of the feeder preferably extends in the direction in which the slider is displaceable.

The means for rotating each hammer head may comprise a turning fork, which receives a coupling pin of a locking mechanism. Such an arrangement will be simple and compact. Because a pivotal movement of the hammer head to the unlocked position is required only for a transfer of the mid-segment, the coupling pin is desirably mounted on a push rod, which is displaceably mounted in the magazine and is biased by energy-storing spring means in the sense in which the hammer head is locked, and said push rod is displaceable against the force of said energy-storing spring means by an unlocking cylinder, which is pivoted in the holding-down ram on a fixed axis adjacent to the feeder. In that embodiment the segment holders of all storage fixtures are opened by an unlocking cylinder which is common to all segment holders and which is actuated to open a given segment holder when the latter is in its transfer position so that the unlocking cylinder can then displace the push rod and the coupling pin against the force of the energy-storing spring means and can thus rotate the hammer head by means of the turning fork to its unlocked position. In all other positions to which the magazine can be displaced the hammer head will be held in its locking position by the energy-storing spring means.

In order to lock the mid-segments in the slide track of the slider and in the receiving opening of the segment changer when it has been displaced to a given position so that the segment can be transferred exactly in the desired position, e.g., to the segment changer, means may be provided for clamping each mid-segment in position in the slide track of the slider and in the receiving opening of the segment changer. Such clamping means should comprise a clamping section of the slide track and a clamping section of a track within the receiving opening and cylinder means for actuating said clamping sections. In that case, additional clamping members will not be required. In a particularly desirable embodiment the slide track of the slider and/or the track in the receiving opening of the feeder consist of dovetail tracks.

BRIEF DESCRIPTION OF THE DRAWING

FIG. 5 is an enlarged sectional view taken on line V—V in FIG. 2,

FIG. 6 is an enlarged sectional view taken on line VI—VI in FIG. 2.

FIG. 7 is an enlarged sectional view taken on line VII—VII in FIG. 3.

DESCRIPTION OF THE PREFERRED EMBODIMENT

Figure 1:
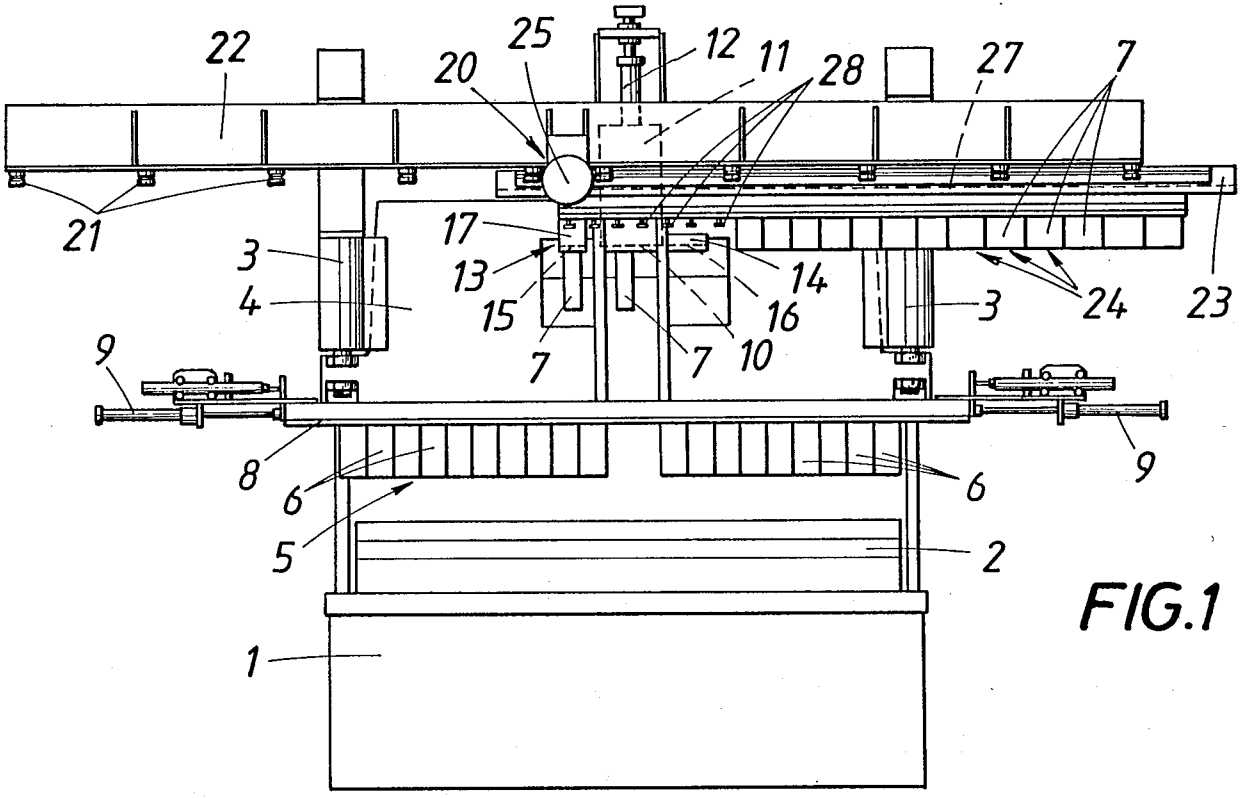
FIG. 1 is a diagrammatic front elevation showing a flanging apparatus in accordance with the invention.

An illustrative embodiment of the invention is shown by way of example in the drawing.

The illustrated embodiment of the apparatus for flanging sheet metal blanks comprises a frame 1 and a holding-down mechanism, which comprises a holding-down ram 4 for cooperation with a backing structure 2. The ram 4 is guided in the frame 1 and by means of fluid-operable cylinders 3 is movable against and away from the backing structure 2. The sheet metal blank to be flanged is adapted to be forced against the backing structure 2 by the holding-down ram 4 and is adapted to be flanged in the usual manner by a bending tool, which is not shown for the sake of clearness. If the sheet metal blank is to be flanged upwardly, a bend line will be defined on the blank by a holding-down shoe 5, which is carried by the holding-down ram 4 at its lower end and is forced against the sheet metal blank by the holding-down ram 4, which constitutes a backing tool for cooperation with the bending tool.

To permit an adaptation of the holding-down shoe 5 to the length of a flange to be formed, the shoe 5 is composed of a plurality of side segments 6, which are arranged in a row that is parallel to said bend line and are disposed on opposite sides of a mid-segment 7 of the holding-down shoe. The side segments 6 are slidably mounted in a track 8, which is carried by or formed on the holding-down ram 4 and is parallel to the bend line. The side segments 6 are displaceable along the track 8 by means of displacing cylinders 9, which are disposed at opposite ends of the holding down shoe 5. Owing to that arrangement, side segments 6 in the number required in view of the length of the flange to be formed on the sheet metal blank can be selected for use and those side segments 6 at the end of the shoe 5 which are not required can be displaced out of the range of the bending tool.

Figure 2:
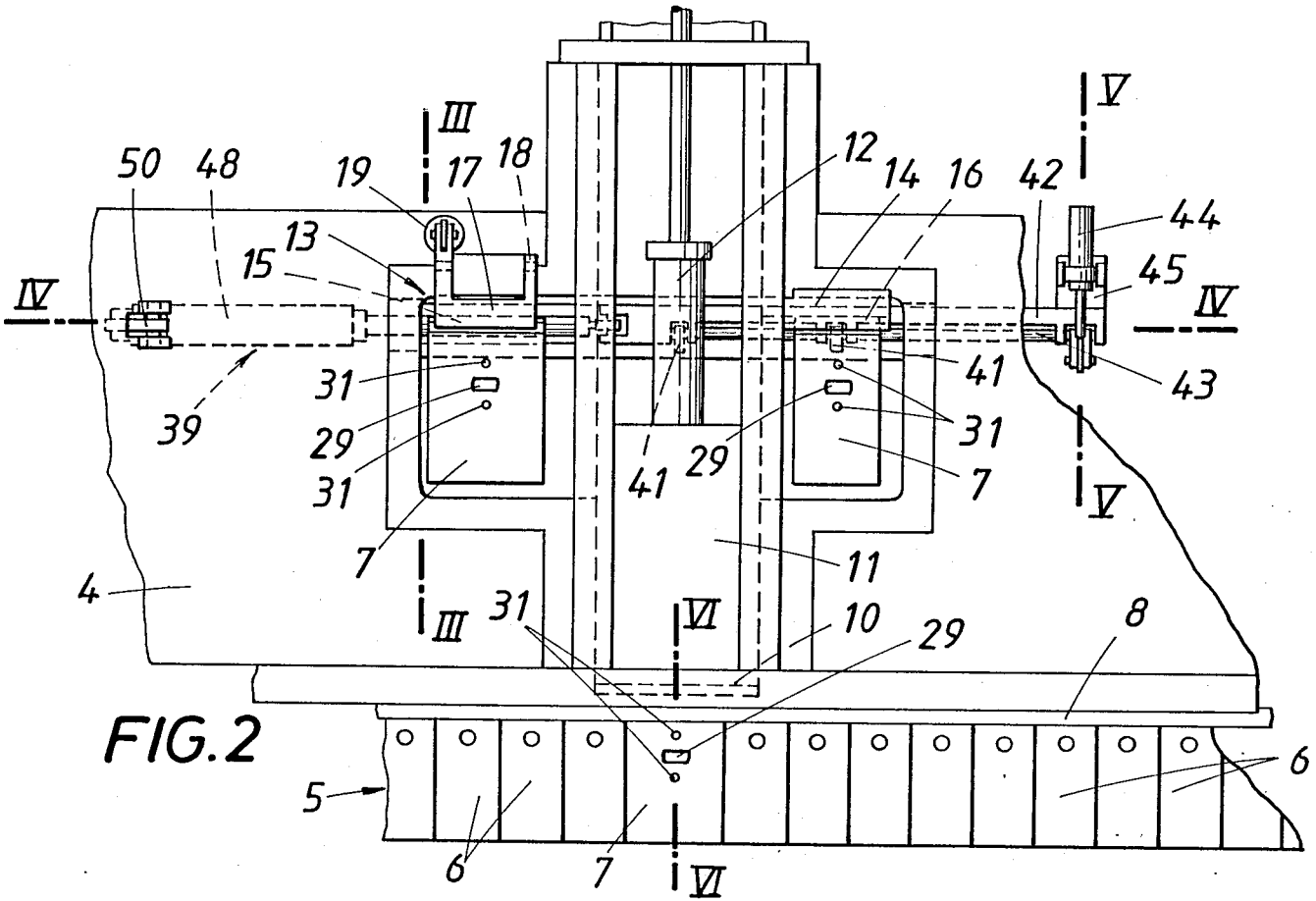
FIG. 2 is an enlarged fragmentary front elevation showing parts of the holding-down mechanism of the apparatus of FIG. 1.

An exact adaptation of the working length of the holding-down shoe 5 to the length of the edge flange to be formed is effected by the selection of one of the mid-segments 7, which differ in length. That mid-segment 7 is held in a slide track 10, that is formed in a slider 11, which is mounted to be displaceable in the direction of movement of the holding-down ram 4 and by means of a cylinder 12 can be reciprocated between a raised or retracted position shown in FIG. 1 and a lower or extended position shown in FIG. 2. When the slider 11 is retracted, the two open ends of the slide track 10 of the slider 11 are respectively disposed adjacent to a segment changer 13 and a stand-by segment holder 14 for the mid-segments 7. More particularly, when the slider 10 is in its retracted position, its slide track 10 extending along the bend line will be aligned with a receiving opening 15 of the segment changer 13 and with a receptacle 16 of the stand-by segment holder. When the slide 11 is in its retracted position, a mid-segment 7 can be reciprocated along the slide track 10 in a simple manner between the slide track 10 of the slider 11, on the one hand, and the segment changer 13 and the stand-by segment holder 14, on the other hand.

The segment changer 13 comprises a feeder 17, which is pivoted to the holding-down ram 4 about an axis 18 which is parallel to the bend line. The feeder 17 is formed with the receiving opening 15 for receiving one mid-segment 7 at a time. The feeder 17 is pivotally movable by a cylinder 19. The arrangement is such that a mid-segment 7 held in the slider 11 can be shifted from the slide track 10 of the slider into the receiving opening 15 of the feeder 17 when the latter has been swung down and the feeder 17 can subsequently be pivotally raised to deliver that mid-segment 7 to a magazine 20. The magazine 20 comprises a carrier 23, which is displaceably mounted on and between profiled rollers 21, which are rotatably mounted on a crossbar 22, which is carried by the frame 1. The carrier 23 is provided with a plurality of storage fixtures 24, which are arranged in a row and are adapted to receive a mid-segment 7 each. That carrier 23 can be moved along the row of segments 6, 7 by a motor 25, which drives a pinion 26 that is in mesh with a rack 27, which extends along the carrier 23. The motor 25 which carries the pinion 26 is mounted on the crosspiece 22 so that each of the storage fixtures 24 can be moved by a suitable rotation of the pinion 26 to a position near the feeder 17 and the mid-segment 7 held by that storage fixture can then be transferred to the feeder 17.

Figure 3:
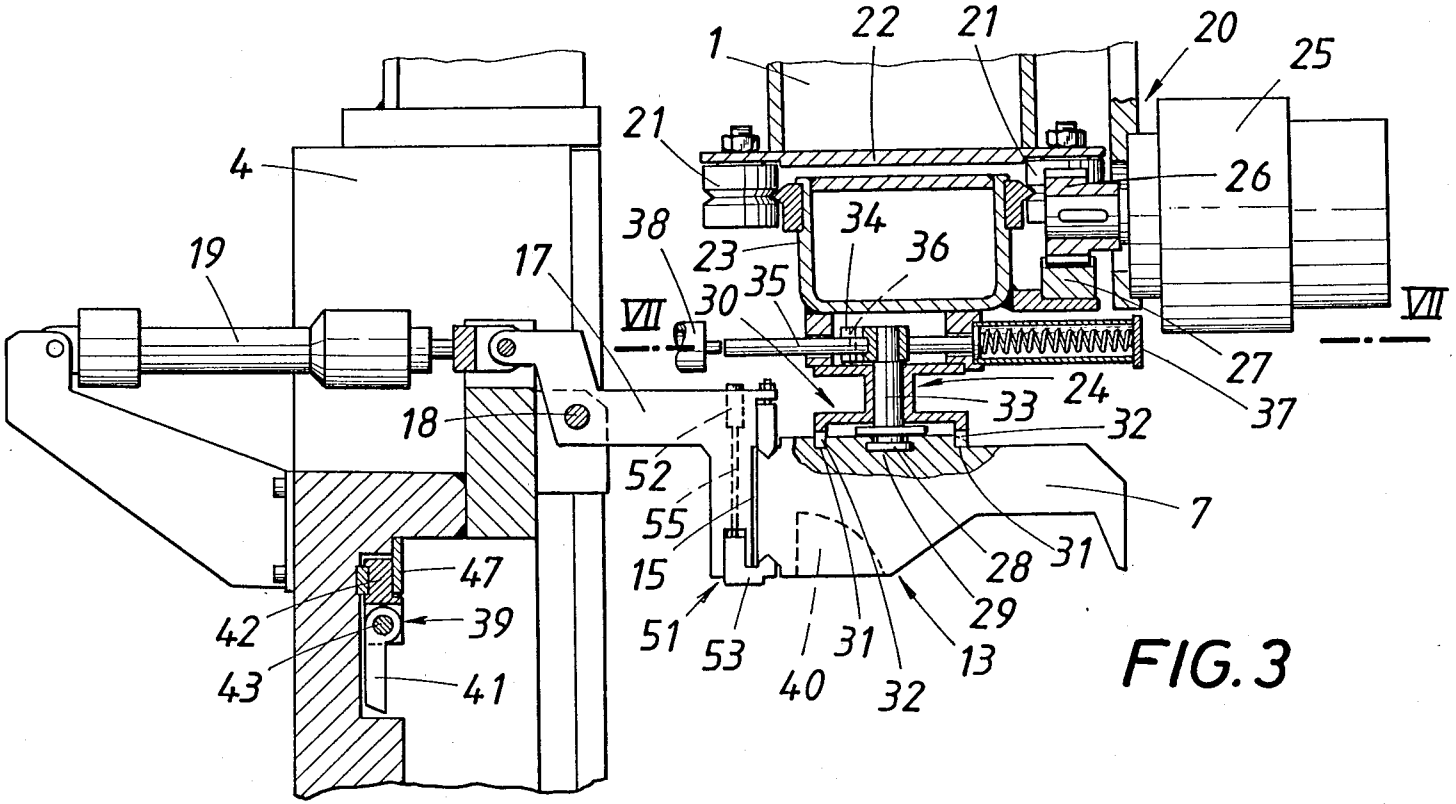
FIG. 3 is an enlarged sectional view taken on line III—III in FIG. 2.

Each of the segment holders 24 for the mid-segments 7 comprises a rotatably mounted hammer head 28, which is adapted to enter an undercut socket opening 29, which is formed in each mid-segment 7 and conforms to the contour of the hammer head 28. When the hammer head 28 has entered the socket opening 29 as the feeder 17 has been swung out and the hammer head 28 is subsequently turned through 90°, each mid-segment 7 which is held by a segment holder 30 of a storage fixture 24 will be locked in said segment holder. To ensure that a mid-segment 7 which has been transferred from the receiving opening 15 of the feeder 17 to a segment holder 30 of a storage fixture 24 will not be rotated relative to the segment holder 30, rotation-preventing locking means are provided between the segment holders 30 of the magazine 20 and each mid-segment 7 in a segment holder 30. Said locking means may comprise stops, which laterally embrace the mid-segments 7, or locking extensions 32, which extend in mating locking recesses 31, as is diagrammatically indicated in FIG. 3.

For a rotation of the hammer head 28, the latter is connected to a shaft 33, which carries a turning fork 34, which receives a coupling pin 36, which is mounted on a push rod 35. The push rod 35 is mounted in the segment holder 30 for a displacement which is transverse to the bend line and to the direction in which the carrier 23 is displaceable. By energy-storing spring means 37, the push rod 35 is biased in a sense for locking the hammer head 28. By means of a single unlocking cylinder 38, each push rod 35 can be displaced against the force of the associated energy-storing spring means 37 in order to insert the associated hammer head 28 into the socket opening 29 of an adjacent mid-segment or to pull said mid-segment out of said opening 29. Because the unlocking cylinder 38 is mounted on the holding-down ram 4 and the magazine 20 is provided at each storage fixture with a push rod 35 and associated energy-storing spring means 37, the head 28 of a given storage fixture 24 cannot be rotated in the unlocking sense unless that storage fixture 24 is in a transfer position next to the feeder 17 and the associated push rod 35 is axially aligned with the unlocking cylinder 38.

Figure 4:
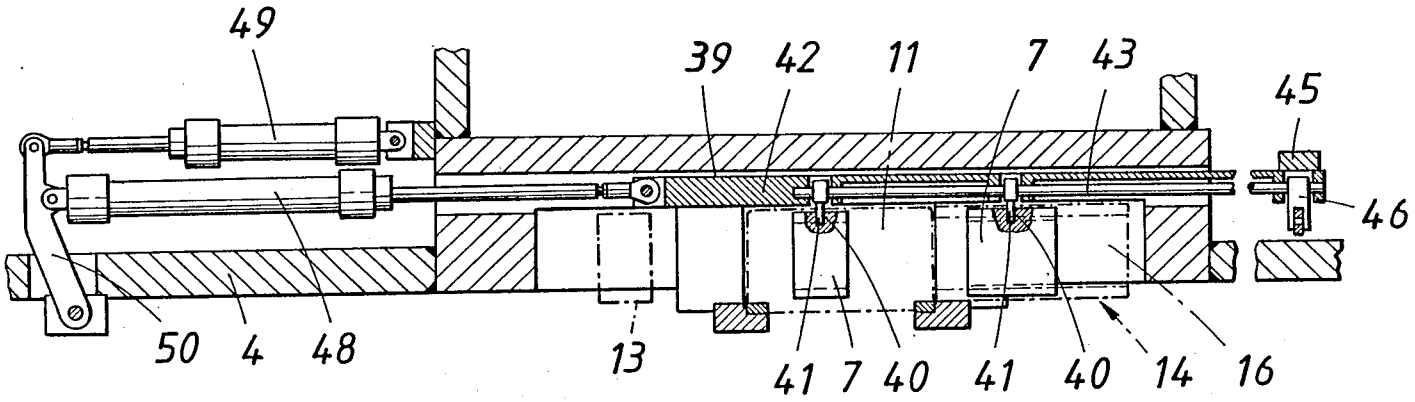
FIG. 4 is an enlarged sectional view taken on line IV—IV in FIG. 2.

A shifting mechanism 39 is mounted in the holding-down ram 4 and serves to shift a given mid-segment 7 between the slider 11, on the one hand, when that slider 11 is in its raised or retracted position, and the segment changer 13 and the stand-by segment holder 14, on the other hand. The shifting mechanism 39 comprises two coupling members 41, which are adapted to extend into a coupling pocket 40 formed in each mid-segment 7. In the embodiment shown in FIGS. 3 and 4 said coupling members 41 consist of pivoted levers, which are mounted on a shaft 43, which is rotatably mounted in and axially fixed to a shifting rod 42. A turning cylinder 44 is provided, which is supported on the shifting rod 42 and operable to rotate the shaft 43. As is particularly apparent from FIG. 5 the shaft 43 carries an arm 46, to which the turning cylinder 44 is pivoted, and the turning cylinder 44 is also movably mounted on a stop plate 45 of the shifting rod 42. Owing to that arrangement the shaft 43 can be rotated to turn the coupling members 41 into the coupling pockets 40 of the adjacent mid-segments 7 so that the latter are operatively connected to the shifting mechanism 39. That operative connection will be eliminated by a rotation of the shaft 43 in the opposite sense.

The shifting rod 42 is displaceably mounted in a slide track 47 (FIG. 3) and is operable by a shifting cylinder 48. To simplify the control, that shifting cylinder 48 can be moved only to the two end positions of its stroke so that the coupling members 41 can be adjusted relative to the shifting cylinder 48 only to two positions, which are spaced apart by the stroke of that cylinder. For this reason, the coupling members 41 are spaced by a distance that is equal to the stroke of the cylinder 48 and which has been selected to match the center distances between the slider, on the one hand, and the segment changer 13 and the stand-by segment holder 14, on the other hand. To permit an adjustment to intermediate positions in spite of said simple control, an auxiliary cylinder 49 is provided for displacing the shifting cylinder 48. As is apparent from FIG. 4 the shifting cylinder 48 is pivoted to a lever 50, which is pivoted to the holding-down ram 4 and is pivotally movable by the auxiliary cylinder 49. Owing to that arrangement the mid-segments 7 can be displaced between the slider 11, on the one hand, and the segment changer 13 and the stand-by segment holder 14, on the other hand, over any distance which may be required.

A given mid-segment 7 which is held in the slide track 10 of the slider 11 or in the receiving opening 15 of the feeder 17 can be locked therein by clamping means 51, which comprise a clamping section 53 of the slide track 10 and a clamping section of a track in the receiving opening and at least one cylinder 52 for actuating each of said clamping sections. The slide track 10 and the track in the receiving opening 15 will consist in that case of an undercut dovetail groove so that the mid-segments will be held in said tracks without a backlash.

It is apparent from FIG. 6 that that section 53 of the slide track 10 which is operable by one or more cylinders 52 is pivoted on an axis 54, which is parallel to the slide track 10, and return springs, not shown, are provided and tend to open the clamping means 51. As is apparent from FIG. 3 the track section 53 provided in the receiving opening 15 is displaceable across the receiving opening 15 and is connected to the cylinder 52 by a tie rod 55. If a plurality of track sections 53 are provided, said sections 53 may be operable in unison by two or more cylinders 52 through the intermediary of a yoke, which is connected to the tie rods 55. Said clamping means may also be opened by means of springs.

Similar clamping means may be provided in the stand-by segment holder 14 adjacent to its receptacle 16. But as the stand-by segment holder need not move, it will be sufficient to hold a mid-segment 7 in position in the stand-by segment holder 14, e.g., by a spring detent. It will be understood that the stand-by segment holder 14, essentially consists of the receptacle 16 in the form of a slide track, which like the slide track 10 of the slider 11 consists also of a dovetail groove.

It will be appreciated by a person skilled in the art that flanging apparatus in accordance with the invention can be provided in that the conventional holding-down mechanism of existing flanging apparatus is replaced by a holding-down mechanism as described hereinbefore.

I claim:

1. In apparatus for flanging a sheet metal blank comprising a frame, a backing structure, and a holding-down mechanism for holding down a sheet metal blank on said backing structure, which holding-down mechanism comprises a holding-down ram, which is mounted in said frame for reciprocation in a predetermined direction toward and away from said backing structure, and a holding-down shoe, which is mounted on said ram and comprises a plurality of segments, which are arranged in a straight row and adapted to be forced by said ram against a sheet metal blank on said backing structure to define on said blank a bend line that is parallel to said row, said segments comprising mid-segment means, which are mounted to be displaceable relative to said ram transversely to said row, and side segments, which are disposed in said row on opposite sides of said mid-segment means and are displaceable relative to said ram along said row, the improvement comprising a slider mounted on said ram for reciprocation in said predetermined direction between extended and retracted positions relative to said ram and provided with a slide track parallel to said row and open at one end and having means to guide said mid-segment means along said track, a mid-segment changer having a receiving opening on said ram be disposed adjacent to and aligned along said row with said open end of said slide track when said slider is in said retracted position, said slider having means to hold said mid-segment means in said slide track in said row when said slider is in said extended position and clear of said row when said slider is in said retracted position, and shifting means on said ram for shifting said mid-segment means between said slide track and said receiving opening when said slider is in said retracted position.

2. The improvement set forth in claim 1, wherein said slide track is open at both ends, a stand-by segment holder is provided, which has a receptacle that is adjacent to and aligned along said row with the other end of said slide track and receives said mid-segment means from said slide track when said slider is in said retracted position, and said shifting means are operable to shift said mid-segment means between said slide track and said receptacle when said slider is in said retracted position.

3. The improvement set forth in claim 2, wherein said shifting means comprise two coupling members, one of which is adapted to shift said mid-segment means between said slide track and said receiving opening and the other of which is adapted to shift said mid-segment means between said slide track and said receptacle when said slider is in said retracted position.

4. The improvement set forth in claim 1, wherein said shifting means comprise a shifting rod, which is mounted in said ram and movable along said row, and a shaft which is rotatably mounted in and axially fixed to said shifting rod, and said mid-segment means comprise a coupling pocket, and each of said coupling members comprises a lever, which is non-rotatably mounted on said shaft and is rotatable by said shaft to enter said coupling pocket of said mid-segment means, when said slider is in said retracted position.

5. The improvement set forth in claim 1, wherein said shifting means comprise a coupling member for shifting said mid-segment means between said slide track and said receiving opening when said slider is in said retracted position.

6. The improvement set forth in claim 3, wherein said shifting means comprise a shifting cylinder for shifting said coupling members along said slide track and an auxiliary cylinder for displacing said shifting cylinder relative to said slide track.

7. The improvement set forth in claim 6, wherein a lever is pivoted to said shifting cylinder and is pivotally movable by said auxiliary cylinder.

8. The improvement set forth in claim 1, wherein said mid-segment changer comprises a magazine provided with a plurality of storage fixtures for holding respective mid-segment means, and a feeder pivoted to said ram and formed with said receiving opening and pivotally movable to transfer mid-segment means disposed in said receiving opening between said one end of said slide track and any of said storage fixtures of said magazine.

9. The improvement set forth in claim 8, wherein said storage fixtures are arranged in a row parallel to said row of segments and said magazine is mounted for movement along said row of segments.

10. The improvement set forth in claim 9, wherein said magazine is mounted on said frame for movement along said row of segments.

11. The improvement set forth in claim 8, wherein each of said storage fixtures comprises a segment holder, which comprises a rotatably mounted hammer head, said mid-segment means comprise an undercut socket opening, which is adapted to receive said hammer head when said mid-segment means are at said storage fixture and said hammer head is rotatable in said socket opening between locking and unlocking positions relative to said mid-segment means.

12. The improvement set forth in claim 11, wherein each of said hammer heads is connected to a turning fork and locking means are provided, which comprise a plurality of coupling pins, which interengage with respective ones of said turning forks.

13. The improvement set forth in claim 12, wherein a push rod is associated with each of said storage fixtures and axially displaceably mounted in said magazine, and carries said coupling pins, energy-storing spring means are associated with each of said push rods and axially urge said push rod in such a direction that said coupling pins tend to move said hammer heads to said locking position by means of said turning forks, an unlocking cylinder is provided, which is movably mounted on said holding down-ram at a fixed location and is operable axially to move each of said push rods against the force of said energy-storing spring means when said unlocking cylinder is axially aligned with said push rods, and said magazine is mounted for movement relative to said ram along said row of segments to positions in which respective ones of said push rods are axially aligned with said unlocking cylinder.

14. The improvement set forth in claim 1, wherein clamping means are provided for clamping said mid-segment means in position in said slide track and in said receiving opening.

15. The improvement set forth in claim 14, wherein said slide track comprises at least one clamping section that is movable transversely to said slide track and said clamping means comprise said clamping section and a cylinder for moving said clamping section transversely to said slide track.

16. The improvement set forth in claim 14, wherein said segment changer is provided with a track for guiding said mid-segment means in said receiving opening, said track in said receiving opening comprises a clamping section that is movable transversely to said track in said receiving opening, and said clamping means comprise said clamping section and a cylinder for moving said clamping section transversely to said slide track.

17. In a holding-down mechanism for holding down a sheet metal blank on a backing structure of a flanging apparatus comprising a frame, which holding-down mechanism comprises a holding-down ram mounted in said frame for reciprocation in a predetermined direction toward and away from said backing structure, and a holding-down shoe, which is mounted on said ram and comprises a plurality of segments, which are arranged in a straight row and adapted to be forced by said ram against a sheet metal blank on said backing structure to define on said blank a bend line that is parallel to said row, said segments comprising mid-segment means, which are displaceably mounted relative to said ram transversely to said row, and side segments, which are disposed in said row on opposite sides of said mid-segment means and are displaceable relative to said ram along said row, the improvement comprising a slider mounted on said ram for reciprocation in said predetermined direction between extended and retracted positions relative to said ram and provided with a slide track parallel to said row and open at one end and provided with means to guide said mid-segment means along said track, a mid-segment changer having a receiving opening on said ram disposed adjacent to and aligned along said row with said open end of said slide track when said slider is in said retracted position, said slider having means to hold said mid-segment means in said slide track in said row when said slider is in said extended position and clear of said row when said slider is in said retracted position, and shifting means on said ram for shifting said mid-segment means between said slide track and said receiving opening when said slider is in said retracted position.

* * * * *